United States Patent [19]

Powers

[11] 4,142,477

[45] Mar. 6, 1979

[54] PORTABLE DOCK

[76] Inventor: Boyd E. Powers, 14216 Jalisco Rd., La Mirada, Calif. 90638

[21] Appl. No.: 814,637

[22] Filed: Jul. 11, 1977

[51] Int. Cl.[2] ..... B63B 5/24

[52] U.S. Cl. ..... 114/263; 9/1.6; 405/219

[58] Field of Search ..... 61/48; 14/71, 72; 114/264, 265, 266, 267, 263; 9/1.1, 1.6

[56] References Cited

U.S. PATENT DOCUMENTS

| | | | |
|---|---|---|---|
| 3,492,825 | 2/1970 | Pearson | 114/263 |
| 3,616,774 | 11/1971 | Thompson | 114/266 |
| 3,620,027 | 11/1971 | Nordell | 114/266 |
| 3,732,587 | 5/1973 | Fletcher | 9/1.1 |

*Primary Examiner*—Trygve M. Blix
*Assistant Examiner*—D. W. Keen
*Attorney, Agent, or Firm*—Howard I. Podell

[57] ABSTRACT

A portable, floating dock which can be towed by a boat using same is provided. The dock has a flat shell with a tapered front section and a gang plank covered with a non-skid material. An eyebolt is provided in the back of the float for securing a boat to it and to stakes driven on the shore. Anchoring tie rings are also provided in the front of the dock for securing same to other stakes driven on the shore.

1 Claim, 6 Drawing Figures

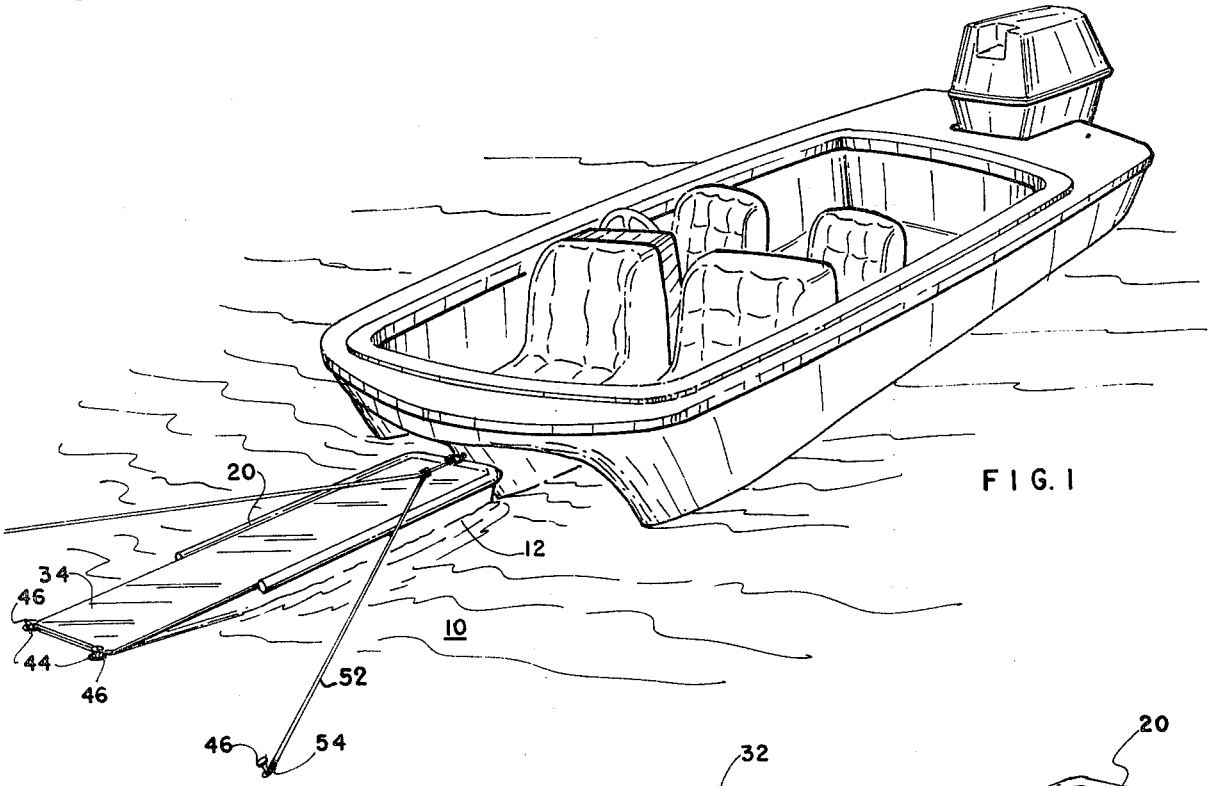
FIG. 1
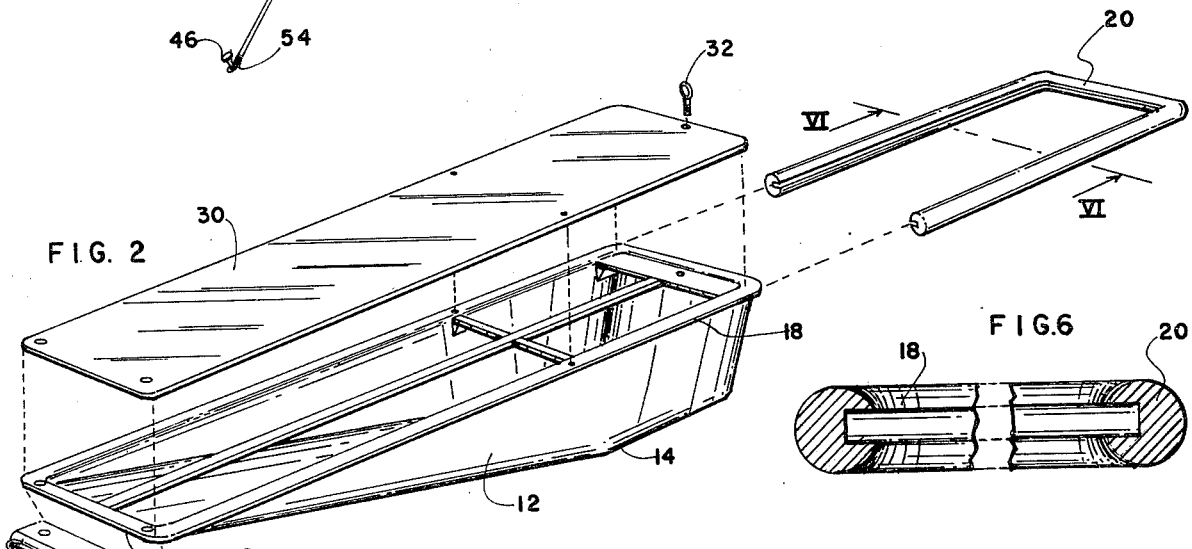
FIG. 2
FIG. 6
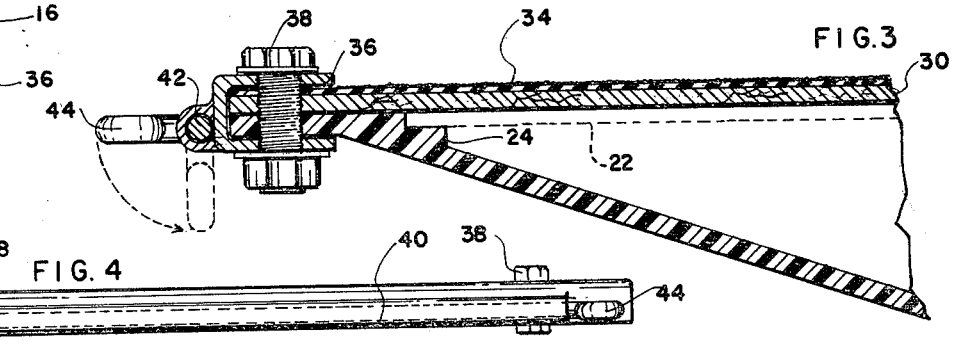
FIG. 3
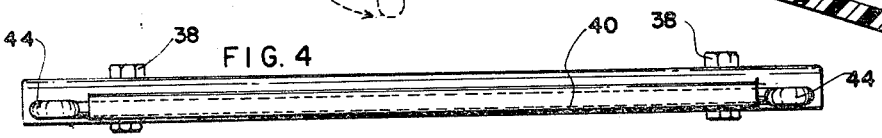
FIG. 4
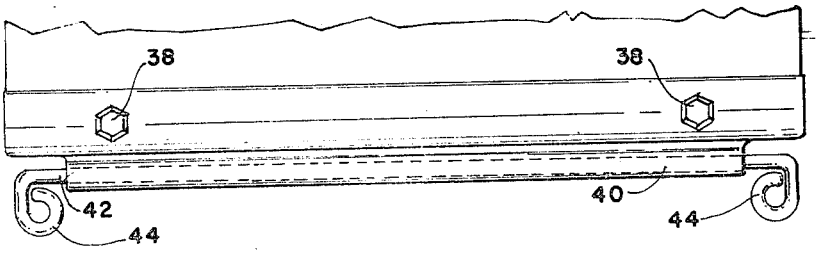
FIG. 5

PORTABLE DOCK

FIELD OF THE INVENTION

This invention relates generally to a portable floating boat dock which is lightweight and inexpensive to construct. The dock has a tapered flat bottom to accomodate varying differences in level between the bank and the water surface where the dock is used.

THE PRIOR ART

The prior art, as exemplified by U.S. Pat. Nos. 3,096,623; 3,043,109; and 2,948,121 is generally illustrative of various devices of this type. While such devices are generally acceptable for their intended purpose, they have not proven to be entirely satisfactory in that they are either comples and expensive to manufacture, or bulky and inconvenient to use, or require unusual skill and/or dexterity to operate. As a result of the shortcomings of the prior art, typified by the above, there has developed and continues to exist a substantial need for devices of the character described. Despite this need, and the efforts of many individuals and companies to develop such devices, a satisfactory device meeting this need has heretofore been unavailable.

The principal object of this invention is to provide a device or article of this character which combines simplicity, strength and durability in a high degree, together with inexpensiveness of construction.

Other objects of this invention will in part be obvious and in part hereinafter pointed out.

The invention accordingly consists in the features of construction, combinations of elements, and arrangement of parts which will be exemplified in the construction hereinafter described, and of which the scope of application will be indicated in the following claims.

BRIEF DESCRIPTION OF THE DRAWINGS:

In the accompanying drawings, in which is shown one of the various possible illustrative embodiments of this invention, wherein like reference character identify the same or like parts:

FIG. 1 is a view in perspective showing the boat deck with a boat tied thereto;

FIG. 2 is an exploded view of the boat deck;

FIG. 3 is a cross-section of the front part thereof;

FIG. 4 is a front elevation of the front part of the dock;

FIG. 5 is a top plan view of the same; and

FIG. 6 is a view taken along line VI-VI of FIG. 2.

DESCRIPTION OF THE PREFERRED EMBODIMENT:

With reference to the drawing, there is shown and illustrated a BOAT DOCK constructed in accordance with the principles of the invention and designated generally by reference character 10.

Referring now in somewhat greater detail to the drawing and by way of a specific example, dock 10 comprises a shell 12 molded of impact resistant plastic 120 × 60 × 0.09 inches. Shell 12 is generally rectangular and has a flat bottom which tapers upwardly toward the front 16 for the greater part of the length of the shell. The upper part of the shell of hull 12 has a flat edge portion 18 which extends beyond the vertical plane of the shell. A generally U-shaped foam rubber bumper strip 20 is bonded to the overlapping edge as shown in FIG. 6.

The shell 12 may be filled with styrofoam or polystyrene beads for improved floatation or simply made air tight. A metal support member 22 is bonded as shown in FIG. 3 to shoulders 24, 26, 28 in the upper part of shell 12. A gangplank 30 is then secured to the support 22 and the top of the hull 12 using contact cement and eyebolt 32 at the boat end of the dock. Preferably gangplank 30 will be of marine or exterior grade plywood. Bonded to the upper surface of gangplank 30 is a cover 34 of rubber or other nonskid material.

With reference to FIGS. 3, 4, and 5, the assembly is made integral at the shore end of the dock by a flattened U-shaped metal sleeve 36 of extruded aluminum fixed transversely at the shore end of the dock. Rivets or bolts 38 secure together the shell and the gangplank within the recess of sleeve 36. Integral with sleeve 36 is a tubular section 40 in which is movably received a metal rod 42 both of whose ends are bent to form stake rings 44 of a diameter such as to receive therein metal stakes 46.

Reverting again to FIG. 1, a boat 50 is shown secured to the boat end of dock 10 by a guy line 52 passed through a ring (not shown) on the boat and the eyelet of bolt 32 and with stake rings 54 at each extremity secured to shore by stakes 46. Owing to the use of stake rings 46 and guy line 52, anchorage of dock 10 is provided against horizontal as well as vertical movement.

Typically, a dock embodying the invention will displace 13.3 cubic feet of water and hold 400 pounds of weight with a safety factor of 300 pounds.

Dock 10 can easily be towed by tying a tow cable from boat 50 to eyebolt 32, or if size permits, it can be carried on board. The dock can be used by any outboard, inboard motor boat or any type of trailerable boat where docks and slips are not furnished.

Among the advantages of the dock of the invention are that it makes it possible to have a boat dock when needed.

The dock's light weight enables it to be hauled and store inside a boat or tie it some place on a boat trailer. Use of the dock avoids need of beaching a boat, eliminating sanding off material on keel and eventaully wearing a hole in it that will have to be repaired, especially fibre-glass boats, scratches and gouges in bottom of boat from sharp rocks, getting lower drive unit of outboard motor and propeller from being mired in mud or sand that could cause damages to the unit or propeller, or damaging propeller by chopping into hidden rocks.

The dock renders easier loading and unloading of passengers, especially the handicapped people and needed supplies. With the dock passengers do not have to wade out into cold shallow water to climb into the boat that could be a chore for some people.

The dock can be towed behind the boat by running a handle of a ski rope into each tie ring. The dock can be used as a diving board when the boat is being used. The dock may be used to do minor repair work on outboard motors without strain, wading in water or pulling the boat out of the water. With this dock, it is possible to tie up a boat at shallow water beaches and still have the propeller in deeper water stay free from mud and other damaging factors.

The operation and use of the invention hereinabove described will be evident to those skilled in the art to which it relates from a consideration of the foregoing.

It will thus be seen that there is provided a device in which the several objects of this invention are achieved, and which is well adapted to meet the conditions of practical use.

It is thought that persons skilled in the art to which this invention relates will be able to obtain a clear understanding of the invention after considering the foregoing description in connection with the accompanying drawing. Therefor, a more lengthy description is deemed unnecessary.

It is to be understood that various changes in shape, size, and arrangement of the elements of this invention as claimed may be resorted to in actual practice, if desired.

Having thus described the invention, what is claimed as new and to be secured by Letters Patent is:

1. A portable boat dock which may be towed by a boat or alternatively moored at a shallow beach to the shore of the beach with a floating boat secured to the dock comprising a flotatable hull, of generally rectangular shape in plan view, having a boat end and a shore end, a generally flat gangplank deck fixed on the upper rim of said hull to form a substantially flat top surface, anchoring means fastened to said shore end of said dock adjacent each side of the shore end of said hull, said anchoring means adaptable for detachable fastening to means secured to the shore, a fastener mounted at the boat end of said dock and extending above the top of the gangplank deck, which fastener is adaptable to be secured by cable means to both a boat floating in the water and to stake means on the shore so as to limit horizontal movement of the dock with respect to the shore, in which the hull is formed with a flat bottom that tapers downwardly from the shore end of the dock for the greater part of the length of the hull so that the shore end of the dock may be positioned on a shore by the anchoring means, with the boat end of the dock floating in water adjacent the said shore of a depth sufficient to float a boat fastened to the fastener at the boat end of the dock.

* * * * *